US005945975A

United States Patent [19]

Lundrigan et al.

[11] Patent Number: 5,945,975

[45] **Date of Patent: *Aug. 31, 1999**

[54] GRAPHICS DISPLAY ADVERTISING SYSTEM FOR A FUEL DISPENSER

[76] Inventors: George L. Lundrigan, 3605 Pinnacle Rd., Austin, Tex. 78746; David Blanchard, 908A Country Aire, Round Rock, Tex. 78664

[ * ] Notice: This patent issued on a continued prosecution application filed under 37 CFR 1.53(d), and is subject to the twenty year patent term provisions of 35 U.S.C. 154(a)(2).

[21] Appl. No.: 08/799,250

[22] Filed: Feb. 14, 1997

Related U.S. Application Data

[60] Provisional application No. 60/016,351, Apr. 30, 1996.

[51] Int. Cl.[6] ..... G09G 5/36

[52] U.S. Cl. ..... 345/133; 364/479.04

[58] Field of Search ..... 345/949, 963, 345/133; 705/14, 16; 364/479.01, 479.04

[56] References Cited

U.S. PATENT DOCUMENTS

| | | | |
|---|---|---|---|
| 3,931,497 | 1/1976 | Gentile et al. | 235/381 |
| 4,107,777 | 8/1978 | Pearson et al. | 705/413 |
| 4,199,100 | 4/1980 | Wostl et al. | 235/381 |
| 4,290,538 | 9/1981 | White et al. | 225/25 |
| 4,395,626 | 7/1983 | Barker et al. | 235/381 |
| 4,395,627 | 7/1983 | Barker et al. | 235/381 |
| 4,461,401 | 7/1984 | Sasnett | 222/27 |
| 4,630,754 | 12/1986 | Komukai | 222/28 |
| 4,906,843 | 3/1990 | Jones et al. | 250/221 |
| 4,958,304 | 9/1990 | Moore | 364/521 |
| 4,967,366 | 10/1990 | Kaehler | 364/479.07 |
| 5,027,282 | 6/1991 | Hollidge | 364/479.02 |
| 5,270,943 | 12/1993 | Warn | 364/479 |
| 5,283,639 | 2/1994 | Esch et al. | 348/6 |
| 5,482,139 | 1/1996 | Rivalto | 186/36 |
| 5,493,315 | 2/1996 | Atchley | 345/516 |
| 5,524,141 | 6/1996 | Braun et al. | 379/93 |
| 5,535,130 | 7/1996 | Long | 364/479 |
| 5,543,824 | 8/1996 | Priem et al. | 345/201 |
| 5,619,274 | 4/1997 | Roop et al. | 348/461 |
| 5,719,781 | 2/1998 | Leatherman et al. | 364/479.02 |
| 5,724,067 | 3/1998 | Atchley et al. | 345/141 |

*Primary Examiner*—Amare Mengistu
*Assistant Examiner*—Ricardo Osorio

[57] ABSTRACT

A graphics display system for a fuel dispenser that is responsive to segments of time, or dayparts, and also shows both pre-made, professional-looking advertisements, as well as locally made text messages. In a preferred embodiment, the graphics display system utilizes the display terminal associated with a card reader device, a display controller with memory, a customer activated terminal ("CAT"), and a point-of-sale ("POS") controller. The system receives graphic frames from a personal computer as well as the POS controller. The system then arranges the graphic frames into chains that are appropriate to the specific day parts. The system also allows individuals to control, insert and delete graphic frames into the chains, thereby making the chains more appropriate for each fuel dispenser as well as each daypart.

15 Claims, 4 Drawing Sheets

GRAPHICS DISPLAY ADVERTISING SYSTEM FOR A FUEL DISPENSER

CROSS REFERENCE TO RELATED APPLICATION

This application claims priority of U.S. Provisional Patent Application Ser. No. 60/016,351, filed on Apr. 30, 1996.

FIELD OF THE INVENTION

The invention relates generally to a fuel dispenser customer interface and, more particularly, to an display system for a fuel dispenser that presents graphical data to a customer.

BACKGROUND OF THE INVENTION

Dispensers for gasoline and other fuels are undergoing many advances in technology. For example, modern dispensers are electrically connected to computing devices that enable a customer to pay for the fuel at the dispenser itself. To receive a payment from the customer, many modern fuel dispensers utilize a credit/debit card device that includes a card reader, a keypad, and a small, inexpensive liquid crystal display that readily displays numerals and a limited amount of text.

The small display associated with a credit/debit card device are ideally suited to display messages such as "INSERT CARD" and "REMOVE CARD QUICKLY" to assist the customer in using the card reader. These messages are effective because the display is located near the card reader, and the instructions for operating the card reader are relatively simple. Furthermore, when not being used to operate the card reader, these displays can display short textual messages such as "GOOD MORNING".

However, once the payment has been received, the short textual messages are only modestly effective in communicating with the customer due to several drawbacks. For one, the messages are generic for use throughout the day and night. Therefore, the "GOOD MORNING" message described above is inappropriate for much of the day. In addition, the messages are not easily modified by a typical store clerk. Most store clerks have access to a computing device, such as a point-of-sale ("POS") controller, for controlling the dispenser. However, the expertise required to use the POS controller to change the messages appearing on the display is relatively high. Therefore, the "GOOD MORNING" message described above can not be simply converted to "GOOD AFTERNOON" at an appropriate time.

Another drawback with the display is that the messages shown thereon are relatively boring and unprofessional-looking. The "look" of a display is important because it needs to keep the customer's attention in order to be effective. An alternative to this drawback is to provide video display units with the fuel dispenser to display full motion video and graphic commercials. However, this solution is too expensive for many applications. Furthermore, this solution does not solve the generic-ness and difficulty in modification drawbacks discussed above.

Therefore, what is needed is a graphics interface that provides some level of control over the timing of the messages.

Furthermore, what is needed is a graphics interface that allows individual stores to easily modify and rearrange the messages.

Furthermore, what is needed is a graphics interface that provides interesting and professional-looking messages, without being too expensive.

SUMMARY OF THE INVENTION

The foregoing problems are solved and a technical advance is achieved by a graphics display system for a fuel dispenser that is responsive to segments of time, or dayparts, and also shows both pre-made, professional-looking advertisements, as well as locally made text messages.

To this end, the graphics display system utilizes the display terminal associated with a card reader device, a display controller with memory, a customer activated terminal ("CAT"), and a point-of-sale ("POS") controller. The system receives graphic frames from a personal computer as well as the POS controller. The system then arranges the graphic frames into chains that are appropriate to the specific day parts. The system also allows individuals to arrange, insert and delete graphic frames from the chains, thereby making the chains more appropriate for each fuel dispenser as well as each daypart.

DETAILED DESCRIPTION OF THE PREFERRED EMBODIMENT

Figure 1:
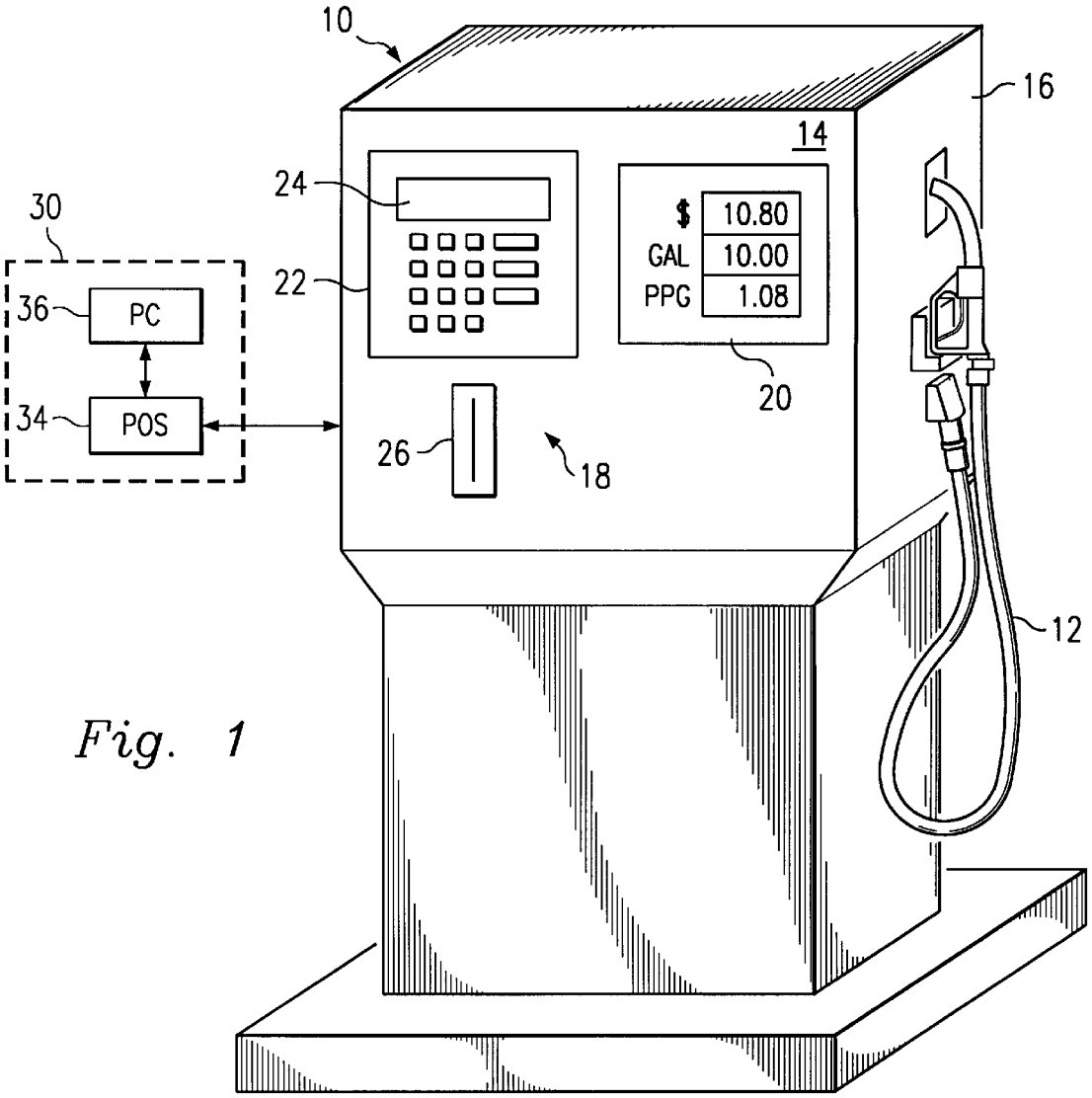
FIG. 1 is a diagram of a fuel dispensing system embodying features of the present invention.

In FIG. 1, the reference numeral 10 refers to a fuel dispensing system embodying features of the present invention. The fuel dispensing system 10 includes a fuel dispenser 11, which contains many elements of a conventional fuel dispenser, such as a fuel nozzle 12 connected to a fuel supply (not shown). The fuel nozzle 12 may also be representative of multiple fuel nozzles, all connected to the fuel dispenser 11. The dispenser 11 has a front side 14 and a back side 16. In the following description of the preferred embodiment, only the front side 14 will be discussed for ease of description. However, the features of the present invention may also be applied on the back side 16, thereby allowing the dispenser to be operated by two customers at the same time.

The front side 14 houses a conventional credit card device 18, and a price board display 20. The price board display 20 comprises a large, conventional, active matrix flat panel display for showing conventional sales data such as total price ("$"), gallons dispensed ("gals."), and price per gallon ("PPG"). The credit card device 18 includes a keypad 22, a graphics display 24, and a card reader 26.

In addition to the dispenser 11, the fuel dispensing system 10 includes a computing center 30. In the preferred embodiment, the computing center 30 is remotely located inside a store (not shown) where it may be readily accessed. The computing center 30 comprises a point-of-sale ("POS") controller 34 and a removable, personal computer ("PC") 36. The POS controller 34 is permanently attached to the fuel dispenser 11, but the PC 36 is selectively connected and used, as described in greater detail with reference to FIG. 2.

It is understood that the PC 36 is a conventional personal computer capable of communicating with the POS controller 34. Also, the POS controller 34 is a conventional dispenser controller capable of controlling the conventional aspects of the dispenser 11, including the fuel nozzle 12 and the credit card device 18.

Figure 2:
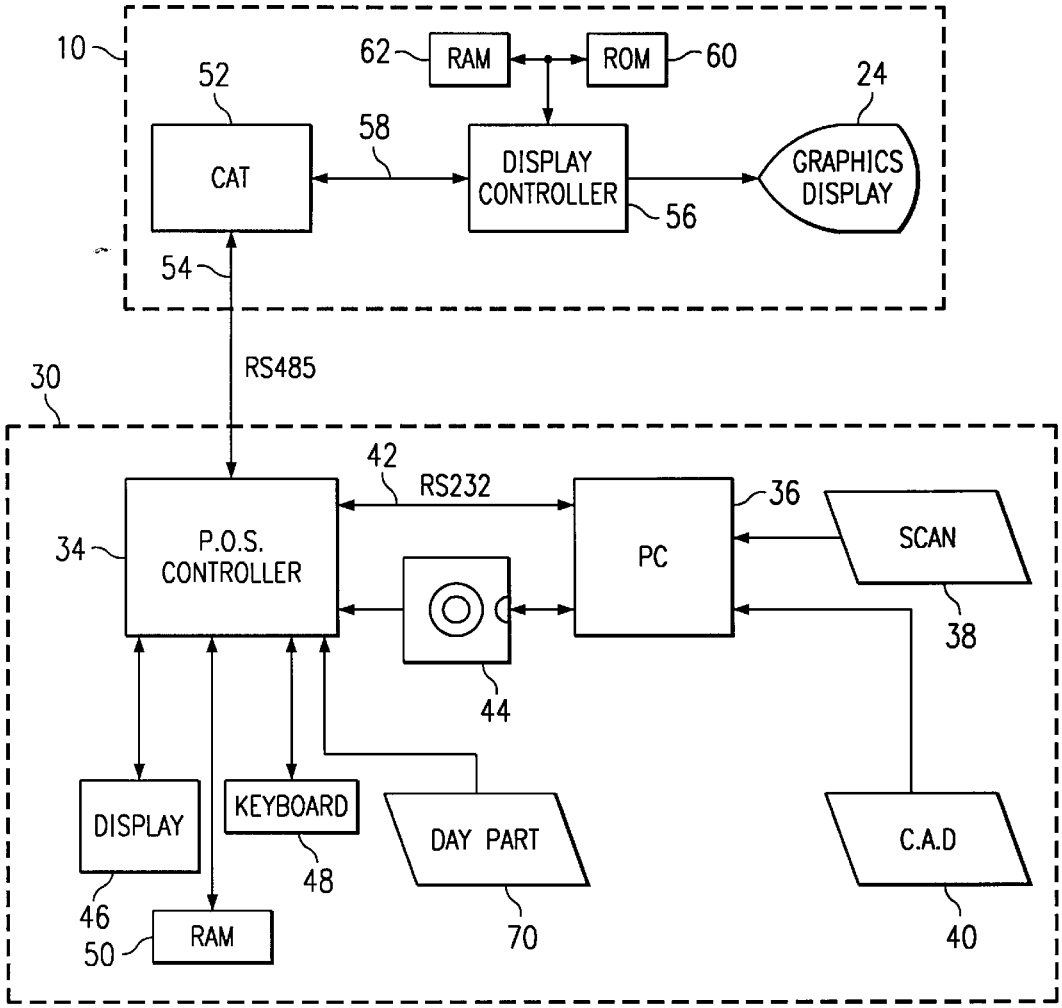
FIG. 2 is a data flow diagram of the fuel dispensing system of FIG. 1 for utilizing the present invention.

FIG. 2 illustrates a data flow for the present invention. It is understood that the fuel dispensing system 10 may be installed at a fuel station as an integrated system of new components or as an upgrade to existing equipment. Furthermore, many of the components described herein are conventional, it being understood that those of ordinary skill in the art can implement such components in the manner described herein.

The PC 36 is used primarily to receive, edit and/or create a plurality of graphic frames. Graphic frames are image files that display a limited amount of textual and graphic data, as discussed further with respect to FIGS. 3–6. The PC 36 may receive the graphic frames through many different types of data input 32. For example, a scanner 38 may be used to scan-in drawings and convert them to a readable format. Alternatively, a computer aided design ("CAD") program 40 may be used to draw the graphic frames on the PC 36 itself.

The PC 36 is connected to the POS controller 34 through an RS232 bus 42. In this way, the PC 36 can transfer the graphic frames to the POS controller 34, and then be quickly disconnected therefrom by removing the bus 42. Alternatively, the graphic frames can be transferred by a floppy disk 44 or by other means well known in the art.

The POS controller 34 includes a display 46, a keyboard 48, touchscreen or similar input device and a memory storage device 50 for performing conventional point-of-sale operations for the fuel dispenser 11. The POS controller 34 also receives the graphic frames from the PC 36 and stores them in the memory storage device 50. The POS controller 34 has a limited capability of creating its own graphic frames. Furthermore, the POS controller is used to define a series of control commands, discussed in greater detail below.

The POS controller 34 is conventionally connected to and communicating with a customer-activated terminal ("CAT") 52 through an RS485 or similar serial communication bus 54, thereby providing the main interface between the computing center 30 and the dispenser 11. A single CAT 52 is used by the dispenser 11 to control a customer interface for both sides 14, 16 of the dispenser. Communications between the POS controller 34 and the CAT 52 include conventional dispenser data that is well understood by those of ordinary skill in the art. The present invention, however, utilizes the bus 54 at times when activity on the bus is low, or idle, to update the CAT 52 with the graphic frames and control commands from the POS controller 34.

The CAT 52 then transfers the graphic frames and control commands to a display controller 56 through a bus 58. The display controller 56 utilizes the frames and commands, along with data stored in a read-only memory ("ROM") 60 and a random access memory ("RAM") 62 for controlling the graphics display 20. In the preferred embodiment, there are two display controllers, two RAMs and two ROMs, one for each side 14, 16 of the dispenser 11. The graphic frames and control commands are arranged into "scenes". Scenes are a series of graphic frames that display an instructional or commercial message. The display controller 56 drives the scenes onto the graphics display 20 as described below.

Figure 3:
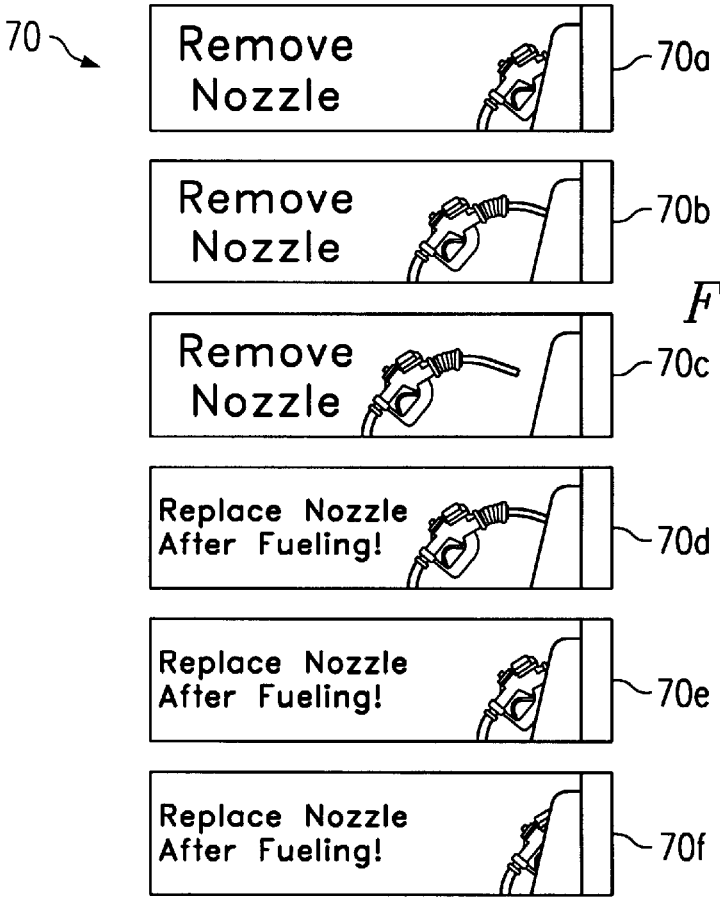
FIGS. 3–6 are illustrations of exemplary graphic frames for use in the fuel dispensing system of FIG. 1.

Referring to FIG. 3, a scene 70 is defined by graphic frames 70*a,* 70*b,* 70*c,* 70*d,* 70*e,* and 70*f.* The scene 70 is used to give instructions on how to operate the fuel nozzle 12 (FIG. 1). Because scene 70 will be used frequently, it is permanently stored in the ROM 60.

Figure 4:
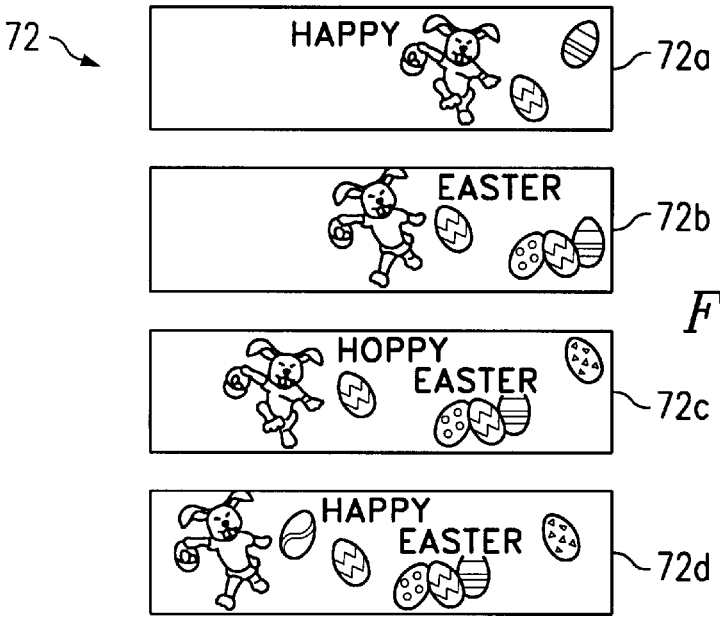

Referring to FIG. 4, a scene 72 is defined by graphic frames 72*a,* 72*b,* 72*c,* and 72*d.* The scene 72 extends a seasonal message. Because scene 72 will only be used at certain times of the year, it is temporarily stored in the RAM 62.

Figure 5:
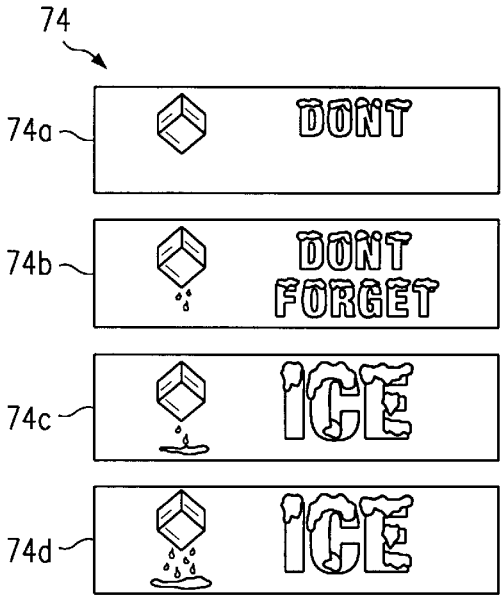

Referring to FIG. 5, a scene 74 is defined by graphic frames 74*a,* 74*b,* 74*c,* and 74*d.* The scene 74 is used to advertise ice. Because scene 74 will be used at certain times of the day or year, it is temporarily stored in the RAM 62.

Figure 6:
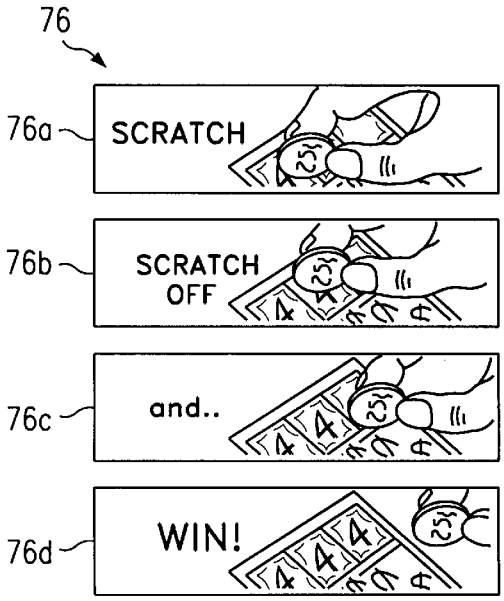

Referring to FIG. 6, a scene 76 is defined by graphic frames 76*a,* 76*b,* 76*c,* and 76*d.* The scene 76 is used to advertise a lottery ticket. Although scene 76 will be frequently displayed, it is subject to frequent changes and therefore, it is temporarily stored in the RAM 62.

Although not shown, one or more graphic frames consisting of textual messages can be generated from the POS controller 34. For example, in scene 74, a new graphic frame can be inserted after frame 74*d* that displays a message such as "ONE BAG COSTS 99¢". This message can be created by using the keyboard 48 of the POS controller 34 to type in the message, and using a simple subroutine (not shown) to convert the message into a graphic frame.

The scenes 70, 72, 74, 76 are controlled by the control commands. The control commands are subdivided into two components: dayparts, and advertisement chains (Ad Chains).

The dayparts component subdivides a day into one or more time slots. For example, referring to Table 1 below, a time slot 1 represents a time period from 5:00 a.m. to 10:30 a.m., a time slot 2 represents a time period from 10:30 a.m. to 9:00 p.m., and a time slot 3 represents a time period from 9:00 p.m. to 5:00 a.m. In this way, the scenes that are appropriate for different times of the day can be shown only in specific dayparts. For example, the ice scene 74 can be shown only during Time Slot 2.

TABLE 1

| | | |
|---|---|---|
| Time Slot 1 | Enable/Disable = | Enable |
| | Start Time = | 5:00 AM |
| | End Time = | 10:30 AM |
| | Ad Chain = | 5 |
| Time Slot 2 | Enable/Disable = | Enable |
| | Start Time = | 10:30 AM |
| | End Time = | 9:00 PM |
| | Ad Chain = | 6 |
| Time Slot 3 | Enable/Disable = | Enable |
| | Start Time = | 9:00 PM |
| | End Time = | 5:00 AM |
| | Ad Chain = | 7 |

The Ad Chain component is a data file used with one or more dayparts to orderly display the desired scenes for each daypart (see Table 1). For example, referring to Table 2 below, an Ad Chain 5 is used to describe a sequence that displays each of the scenes 70 and 72. Each graphic frame of the scenes includes a frame sequence number, a filename, a duration representing an amount of time each frame will be displayed, a brief description of the frame, and a storage location for the frame (ROM 60 or RAM 62). Although the scenes are shown in a particular order, e.g. 72*a,* 72*b,* 72*c,* 72*d,* the Ad Chain can be modified to rearrange the order of the scenes, or to insert different frames between the scenes.

TABLE 2

Ad Chain 5:

| Frame No. | Filename | Duration (0.1 sec.) | Description | Storage Location |
|---|---|---|---|---|
| 1 | nozzle1.img | 10 | Remove Nozzle (70a) | ROM (60) |
| 2 | nozzle2.img | 10 | Remove Nozzle (70b) | ROM (60) |
| 3 | nozzle3.img | 20 | Remove Nozzle (70c) | ROM (60) |
| 4 | nozzle4.img | 10 | Remove Nozzle (70d) | ROM (60) |
| 5 | nozzle5.img | 10 | Remove Nozzle (70e) | ROM (60) |
| 6 | nozzle6.img | 20 | Remove Nozzle (70f) | ROM (60) |
| 7 | blank1.img | 4 | Blank Screen | ROM (60) |
| 8 | easter1.img | 10 | Happy Easter (72a) | RAM (62) |
| 9 | easter2.img | 10 | Happy Easter (72b) | RAM (62) |
| 10 | easter3.img | 10 | Happy Easter (72c) | RAM (62) |
| 11 | easter4.img | 30 | Happy Easter (72d) | RAM (62) |

Figure 7:
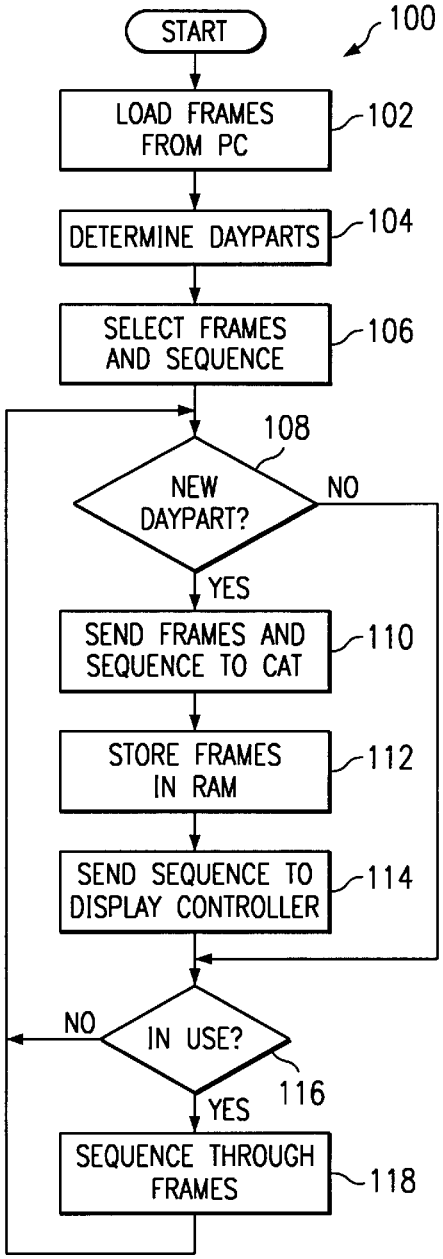
FIG. 7 is a flow chart describing the operation of the fuel dispensing system of FIG. 1 in accordance with the present invention.

Referring to FIG. 7, a routine 100 is utilized to display the graphic frames on the graphics display 24 (FIG. 2). In the preferred embodiment, processing of the routine 100 is shared between the PC 36, POS controller 34, the CAT 52 and the display controller 56. Execution begins at step 102, where the graphic frames are loaded from the PC 36 into the storage device of the POS controller 34. In the preferred embodiment, this step is performed by a utility program, running on the PC 36, that stores the frames into the storage device 50. At step 104, the dayparts are defined. This is executed by the POS controller 34, as described above with reference to Table 1. At step 106, the Ad Chain associated with each daypart is defined. This is also executed by the POS controller 34, as described above with reference to Table 2.

At step 110, a determination is made as to whether a new daypart is about to begin. This is done by comparing the start times for each Time Slot to a real time clock (not shown). If a new daypart is not about to begin, execution jumps to step 116, discussed below. If a new daypart is about to begin, execution proceeds to step 110, where the POS controller 34 sends the appropriate Ad Chain to the CAT 52. As determined by the Ad Chain, the CAT 52 stores certain graphic frames in the RAM 62. At step 114, the CAT 52 sends the control command data, such as sequence and duration, to the display controller 56.

At step 116, a determination is made as to whether the dispenser 11 is being used by a customer. If so, execution proceeds to step 118, where the display controller 56 sequences through the Ad Chain, displaying graphic frames according to the sequence and duration data. Upon completion of step 118, execution loops back to step 108. If at step 116, a determination is made that the dispenser 11 is not being used by a customer, execution loops back to step 108.

Although illustrative embodiments of the present invention have been shown and described, a latitude of modification, change and substitution is intended in the foregoing disclosure, and in certain instances, some features of the invention will be employed without a corresponding use of other features. For example, the dispenser may include a speaker so that a combination of sound files and graphic frames can provide a multimedia environment. Accordingly, it is appropriate that the appended claims be construed broadly and in a manner consistent with the scope of the invention.

What is claimed is:

1. A fuel dispensing system with customer graphics capabilities, the system comprising:

a fuel dispenser;

a plurality of advertising chains each comprising one or more graphic frames;

means for defining a plurality of dayparts corresponding to specific times of day;

means for specifying one of the advertising chains for a first daypart;

a graphics display included on the fuel dispenser for displaying the specified advertising chain;

a display controller for downloading the advertising chains onto the graphics display if a current time of day is in the first daypart; and a point-of-sale ("POS") controller for controlling the fuel dispenser, creating site-specific graphic frames, and specifying the graphic frames in each advertising chain.

2. The system of claim 1 wherein the graphic frames are arranged into one or more scenes.

3. The system of claim 1 wherein each advertising chain includes a sequence and duration associated with each graphic frame.

4. The system of claim 3 wherein the display controller drives the graphic frames according to the sequence and duration.

5. The system of claim 1 wherein the graphic frames are generated by a personal computer.

6. The system of claim 5 wherein the graphic frames are scanned into the personal computer.

7. The system of claim 5 wherein the graphic frames are drawn with a computer aided design program.

8. In a fuel dispenser system including a point-of-sale ("POS") terminal and a fuel dispenser with a display, a method for displaying a plurality of graphic frames on the display, the method comprising:

loading graphic frames from the POS terminal into a display controller;

defining a plurality of dayparts corresponding to specific times of day;

for a daypart, specifying a chain of graphic frames to be displayed;

sending one of the chains of graphic frames to a first memory device;

determining if a current time of day is in the daypart; and if the current time of day is in the daypart, displaying the chain of graphic frames on the display;

whereby the displayed chain of graphic frames provides an advertisement to a user of the fuel dispenser that corresponds with the current time of day.

9. The method of claim 8 further comprising the step of providing graphic frames in a second memory device.

10. The method of claim 8 wherein each chain includes a sequence of the graphic frames and a display duration for each graphic frame.

11. The method of claim 8 further comprising:

selecting a subset of graphic frames from a larger group of graphic frames;

arranging the selected graphic frames in a sequence;

defining a duration for each graphic frame; and forming the chain of graphic frames from the selected graphic frames, the duration, and the sequence.

12. The method of claim 8 further comprising the step of creating graphic frames in the POS controller.

13. The method of claim 8 further wherein the step of displaying is done in response to a user action.

14. The method of claim 13 wherein the user action is dispensing fuel.

15. The method of claim 8 wherein the graphic frames include a combination of text and graphics.

* * * * *

UNITED STATES PATENT AND TRADEMARK OFFICE

CERTIFICATE OF CORRECTION

PATENT NO. : 5,945,975

DATED : August 31, 1999

INVENTOR(S) : George L. Lundrigan, David Blanchard

It is certified that error appears in the above-identified patent and that said Letters Patent is hereby corrected as shown below:

Title page, please add assignee information as follows:

[73] Assignee: Dresser Industries, Inc., Dallas, TX

Title page, please add firm information as follows:

*Attorney, Agent, or Firm* - Haynes & Boone, L.L.P.

Signed and Sealed this

Fifteenth Day of February, 2000

*Attest:*

*Attesting Officer*

Q. TODD DICKINSON

*Commissioner of Patents and Trademarks*